US008297241B2

(12) United States Patent
Alajoki et al.

(10) Patent No.: US 8,297,241 B2
(45) Date of Patent: Oct. 30, 2012

(54) HYDRAULIC ACTUATOR

(75) Inventors: Juha Alajoki, Espoo (FI); Pekka Hautala, Espoo (FI); Jyrki Kajaste, Nummela (FI); Jukka Kiijärvi, Kylmälä (FI); Petri Kuosmanen, Espoo (FI); Markus Niemi, Vantaa (FI)

(73) Assignee: Wärtsilä Finland Oy, Vaasa (FI)

( * ) Notice: Subject to any disclaimer, the term of this patent is extended or adjusted under 35 U.S.C. 154(b) by 346 days.

(21) Appl. No.: 12/667,487

(22) PCT Filed: Jul. 2, 2008

(86) PCT No.: PCT/FI2008/050402

§ 371 (c)(1), (2), (4) Date: Mar. 24, 2010

(87) PCT Pub. No.: WO2009/004116

PCT Pub. Date: Jan. 8, 2009

(65) Prior Publication Data

US 2010/0199933 A1 Aug. 12, 2010

(30) Foreign Application Priority Data

Jul. 4, 2007 (FI) ..... 20075504

(51) Int. Cl.
*F01L 9/02* (2006.01)

(52) U.S. Cl. ..... 123/90.12; 123/90.16

(58) Field of Classification Search ..... 123/90.15, 123/90.16, 90.12, 90.13
See application file for complete search history.

(56) References Cited

U.S. PATENT DOCUMENTS

| | | | |
|---|---|---|---|
| 5,287,829 | A | 2/1994 | Rose |
| 5,529,030 | A | 6/1996 | Rose |
| 6,263,842 | B1 | 7/2001 | De Ojeda et al. |

FOREIGN PATENT DOCUMENTS

| | | | |
|---|---|---|---|
| DE | 2155409 | A1 | 5/1972 |
| DE | 19956299 | C1 | 8/2001 |
| FR | 2174731 | A | 10/1973 |
| GB | 2154027 | A | 8/1985 |
| WO | 0014388 | A1 | 3/2000 |

OTHER PUBLICATIONS

Busto, Mario, International Search Report for PCT/FI2008/050402, Nov. 4, 2008.
Raimo Hellgren, Finnish Search Report for FI 20075504, Apr. 8, 2008.

*Primary Examiner* — Zelalem Eshete
(74) *Attorney, Agent, or Firm* — Chernoff Vilhauer McClung & Stenzel LLP

(57) ABSTRACT

A hydraulic actuator (1) comprising a body (2), in which a control arm (5) and a lift means (6) provided with a piston surface (22) are arranged, which lift means is arranged to follow the reference movement of the control arm (5), and an inlet port (3) and an outlet port (4) for hydraulic medium. The body (2) encloses a pressure chamber (10) delimited by the piston surface (22) of the lift means (6), and the movement of the control arm (5) provides a flow connection between the inlet port (3) and the pressure chamber (10) in order to move the lift means (6), and the movement of the control arm (5) in the opposite direction provides a flow connection between the pressure chamber (10) and the outlet port (4) in order to move the lift means (6) in the opposite direction.

10 Claims, 4 Drawing Sheets

HYDRAULIC ACTUATOR

This is a national stage application filed under 35 USC 371 based on International Application No. PCT/FI2008/050402 filed Jul. 2, 2008 and claims priority under 35 USC 119 of Finnish Patent Application No. 20075504 filed Jul. 4, 2007.

The present invention relates to a hydraulic actuator suitable for instance for controlling the inlet and outlet valves of a piston engine cylinder.

Conventionally in piston engines, the gas exchange valves of the cylinders are controlled by a camshaft, which is by means of a chain or belt connected so that it rotates with the crankshaft of the engine. Thus, all the valves in a cylinder row are controlled by the same camshaft or alternatively, the inlet and outlet valves both have their respective camshafts. In operation, it is not possible to change the adjustment of the timing of the valves in a desired way when using a valve mechanism driven by a camshaft, whereby the timing of the valves is always a compromise.

Due to the increasingly stringent emission regulations the engine manufacturers are obliged to decrease engine emissions. At the same time the aim is to keep the engine performance unchanged or even to improve it. This is possible only through precise real time adjustment and control of the engine. The control of fuel supply has improved considerably along with the introduction of electrically controlled fuel injection. In addition to this, the control of gas exchange valves should be improved in order to make the engine as efficient as possible at all engine rotation speeds and engine loads. Individual control of gas exchange valves improves the efficiency, fuel economy and output of the engine and reduces emissions. This is not possible with a valve mechanism driven by a camshaft.

An object of the present invention is to provide a hydraulic actuator, by which the gas exchange valves of a piston engine can be controlled individually.

The objects of the invention are achieved as disclosed in the appended claim 1. The hydraulic actuator according to the invention comprises a body, in which a control arm and a lift means provided with a piston surface are arranged, which lift means is arranged to follow the reference movements of the control arm, and an inlet port and an outlet port for hydraulic medium. The body encloses a pressure chamber delimited by the piston surface of the lift means. The movement of the control arm provides a flow connection between the inlet port and the pressure chamber in order to move the lift means, and the movement of the control arm in the opposite direction provides a flow connection between the pressure chamber and the outlet port in order to move the lift means in the opposite direction.

Considerable advantages are achieved by the present invention.

By the actuator according to the invention the gas exchange valves of an engine can be controlled more accurately than by means of a camshaft. Also the timing of the gas exchange valves can be changed easily and individually, e.g. according to the engine load. Moreover, the structure of a hydraulic actuator according to the invention may be made compact, whereby it is easily adaptable wherever it is used.

In the following, the invention is explained in more detail with reference to the examples shown in the appended drawings.

By the hydraulic actuators 1 shown in the figures for instance gas exchange valves, i.e. the inlet and outlet valves, of a piston engine cylinder are controlled. For this purpose, the hydraulic actuator 1 is attached to the cylinder head of the engine. The actuator is in operational connection with a gas exchange valve. In all embodiments the hydraulic actuator 1 is given a reference movement by an actuator 20, whereby the hydraulic actuator transmits the movement to the gas exchange valve. For instance an electric solenoid driven by the control system of the engine may be used as an actuator 20. Alternatively, the actuator 20 may be a so-called voice coil, in which a magnetic field is provided by permanent magnets or electromagnets. A coil operating as an armature for the actuator is placed to run in the magnetic field. Current is conducted to the coil, whereby the current together with the magnetic field generate a force that moves the coil. The magnitude of the force is proportional to the magnitude of the current.

Figure 1:
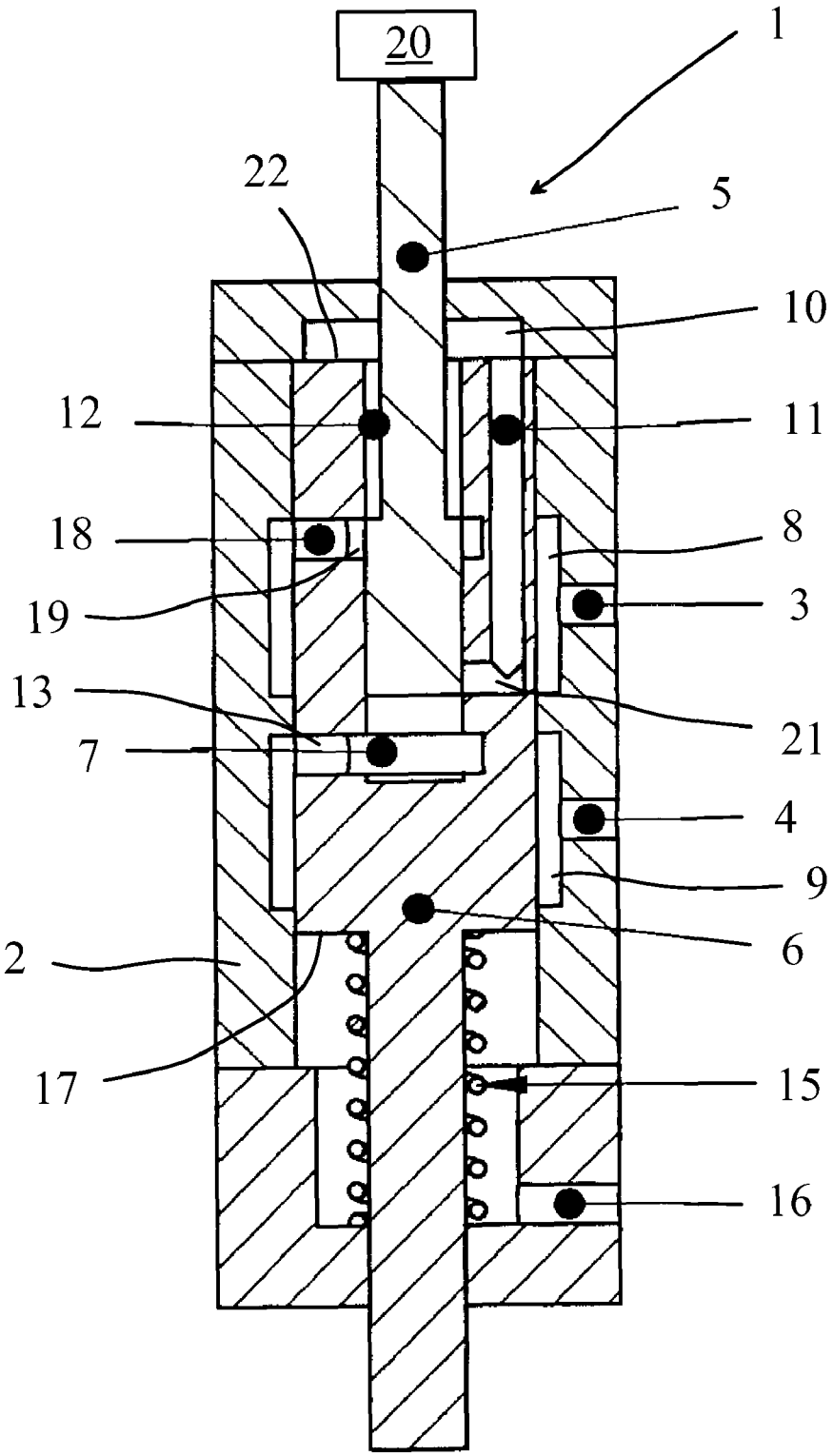
FIG. 1 is a cross-sectional view of one hydraulic actuator according to the invention.

The hydraulic actuator 1 shown in FIG. 1 comprises a body 2 with an inlet port 3 and an outlet port 4 for hydraulic medium. A control arm, e.g. a slide 5, and a lift means 6, which are movable with respect to one another, are arranged in the body 2. The first end of the slide 5 projects from the first end of the body 2 and the second end is located inside the lift means 6 in the body 2. The slide 5 is in operational connection with an actuator 20. The slide 5 is moved by the actuator 20, whereby the movement of the slide 5 is transmitted to the lift means 6 via the hydraulic circuit in the hydraulic actuator 1. The lift means 6 is in operational connection with the gas exchange valve of the cylinder in order to control it, i.e. to move it back and forth between an open and closed position.

The inlet port 3 is in flow connection with a source of hydraulic medium, e.g. with the forced lubrication system of the engine. The inlet port 3 is in continuous flow connection with a feed chamber 8 in the body 2. Hydraulic medium is fed by a pump from the source of hydraulic medium through the inlet port 3 into the feed chamber 8. The source of hydraulic medium is for instance the forced lubrication system of the piston engine. Hydraulic medium is discharged from the hydraulic actuator 1 via the outlet port 4, which is in flow connection with a tank for hydraulic medium, e.g. the oil sump of the engine. The outlet port 4 is in continuous flow connection with a discharge chamber 9 in the body. Both the feed chamber 8 and the discharge chamber 9 are annular. The feed chamber 8 and the discharge chamber 9 encircle the lift means 6.

The feed chamber 8 is through a bore 18 in the lift means 6 in continuous flow connection with a ring channel 19 encircling the slide 5. Also the ring channel 19 is located in the lift means 6. In addition, the lift means 6 comprises a lifter chamber 7 delimited by the second end of the slide 5. The lifter chamber 7 is in continuous flow connection with the discharge chamber 9 via a connecting channel 13 in the lift means. A pressure chamber 10, which is in flow connection with a side channel 12 and a second side channel 11, is provided at the first end of the body 2. The second side channel 11 is located in the lift means 6. The side channel 12 runs between the slide 5 and the lift means 6. The lift means 6 is provided with a piston surface 22 delimiting the pressure chamber 10.

A chamber 14 delimited by a second piston surface 17 of the lift means 6 is provided at the second end of the body 2. The chamber 14 encloses a spring 15, which urges the lift means 6 toward the first end of the body. Instead of, or in addition to, the spring 15 the lift means 6 may be loaded in a similar way by pressurised hydraulic medium, which is led into the chamber 14 through a pressure conduit 16. The pressure of the hydraulic medium in the chamber 14 is kept constant. Hydraulic medium may be supplied into the chamber 14 from the same source as into the feed chamber 8.

While the slide 5 is forced downwards by the actuator 20, i.e. into the body 2, from the position shown in FIG. 1, the flow connection between the bore 18 and the by side channel 12, i.e. between the inlet port 3 and the pressure chamber 10, is opened. Then, hydraulic medium flows from the feed chamber 8 via the bore 18, ring chamber 19 and side channel 12 into the pressure chamber 10. Thus, the pressure prevailing in the feed chamber 8 is transferred into the pressure chamber 10 and the force exerted by the pressure on the piston surface 22 forces the lift means 6 against the spring pressure of the spring and/or against the force exerted on the second piston surface 17 by the pressure of the fluid in the chamber 14. The area of the second piston surface 17 is smaller than that of the piston surface 22 and/or the pressure of the hydraulic medium in the chamber 14 is lower than that in the pressure chamber 10, whereby the lift means 6 moves downwards, i.e. projects outwards from the body 2. At the same time, hydraulic medium flows out of the chamber 14 via the pressure conduit 16. As soon as the lift means 6 has moved to a position, in which the flow connection between the bore 18 and the side channel 12 breaks, the movement of the lift means 6 stops. Also the flow connection between the inlet port 3 and the pressure chamber 10 breaks. The reference movement given to the slide 5 by the actuator 20 is transmitted to the lift means 6 via the hydraulic circuit of the hydraulic actuator 1.

While the slide 5 is moved by the actuator 20 in the opposite direction, i.e. outwards from the body 2, the flow connection between a second bore 21 and the lifter chamber 7, i.e. between the pressure chamber 10 and the outlet port 4, is opened. Then, hydraulic medium flows from the pressure chamber 10 via the second side channel 11, second bore 21, lifter chamber 7 and connecting channel 13 into the discharge chamber 9. From the discharge chamber 9, hydraulic medium is led via the outlet port 4 to a tank for hydraulic medium. Since the force exerted on the lift means 6 by the pressure of the hydraulic medium prevailing in the pressure chamber 10 is reduced, the lift means 6 moves in the opposite direction, i.e. upwards, due to the force generated by the spring 15 and/or the pressure prevailing in the chamber 14. As soon as the lift means 6 has moved to a position, in which it breaks the flow connection between the second bore 21 and the lifter chamber 7, the movement of the lift means 6 stops.

Figure 2:
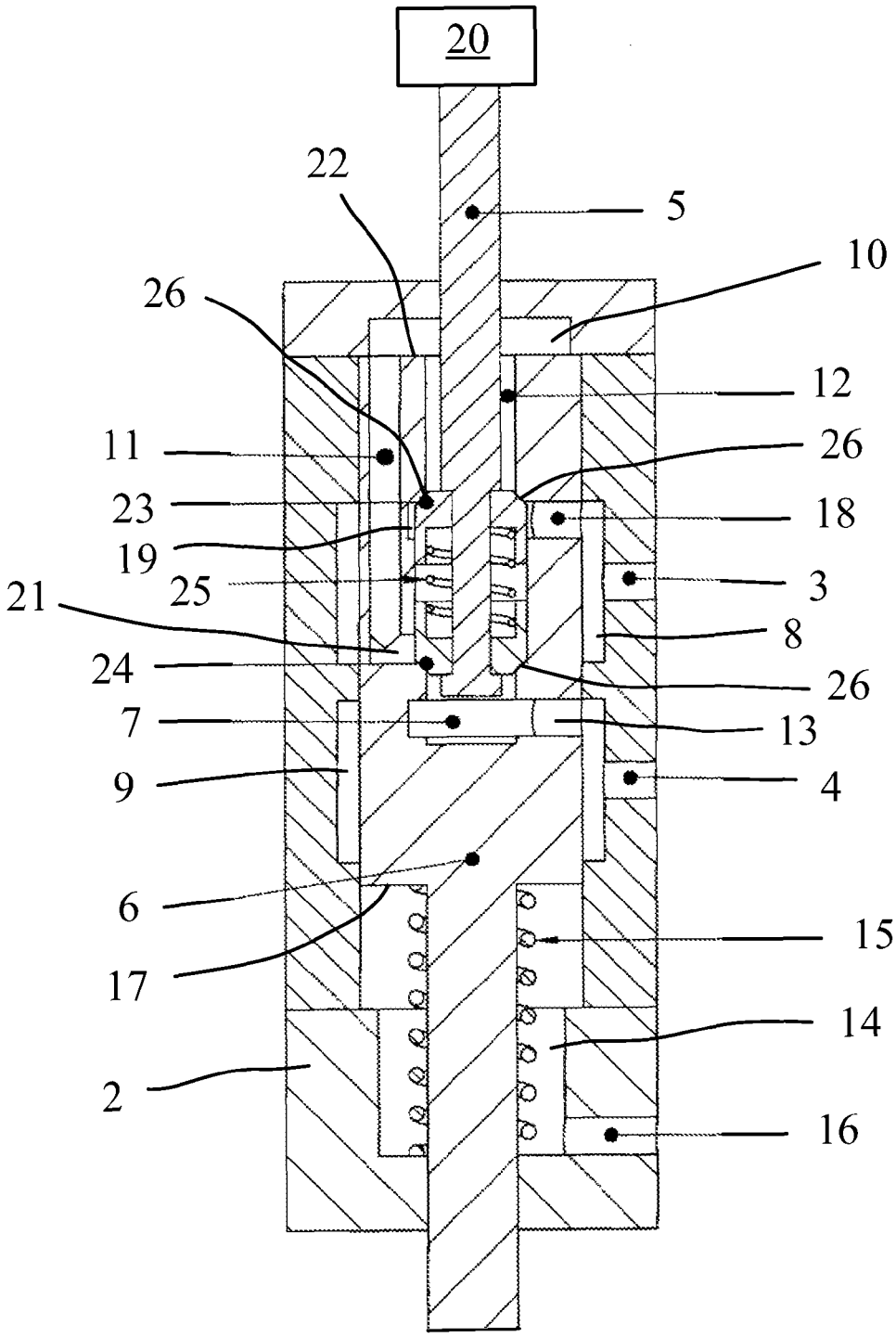
FIG. 2 is a cross-sectional view of a second hydraulic actuator according to the invention.

The hydraulic actuator 1 according to FIG. 2 is mainly similar to the hydraulic actuator according to FIG. 1. In FIG. 2, the same type of components are marked with the same reference numbers as in FIG. 1. The slide acting as a control arm is replaced by a control arm 5 provided with two spring-actuated seat valves 23, 24. The first seat valve 23 and the second seat valve 24 are arranged around the control arm 5, more specifically around the recess in the control arm 5. The ends of the seat valves 23, 24 rest against the shoulders of the control arm. Between the valves 23, 24 there is a spring 25 that urges the valve bodies against the shoulders and the seat surfaces 26 on the lift means 6.

The hydraulic actuator 1 in FIG. 2 comprises a body 2 with an inlet port 3 and an outlet port 4 for hydraulic medium. A control arm 5 and a lift means 6, which are movable with respect to one another, are arranged in the body 2. The first end of the control arm 5 projects from the first end of the body 2 and the second end is located inside the lift means 6 in the body 2. The control arm 5 is in operational connection with an actuator 20. The control arm 5 is moved by the actuator 20, whereby the movement of the control arm 5 is transmitted to the lift means 6 via the hydraulic circuit in the hydraulic actuator 1. The lift means 6 is in operational connection with the gas exchange valve of the cylinder in order to control it, i.e. to move it back and forth between an open and closed position.

The inlet port 3 is in flow connection with a source of hydraulic medium, e.g. with the forced lubrication system of the engine. The inlet port 3 is in continuous flow connection with a feed chamber 8 in the body 2. Hydraulic medium is fed by a pump from the source of hydraulic medium through the inlet port 3 into the feed chamber 8. Hydraulic medium is discharged from the hydraulic actuator 1 via the outlet port 4, which is in flow connection with a tank for hydraulic medium, e.g. with the oil sump of the engine. The outlet port 4 is in continuous flow connection with a discharge chamber 9 in the body. Both the feed chamber 8 and the discharge chamber 9 are annular. The feed chamber 8 and the discharge chamber 9 encircle the lift means 6.

The feed chamber 8 is through a bore 18 in the lift means 6 in continuous flow connection with a ring channel 19 encircling the control arm 5. Also the ring chamber 19 is located in the lift means 6. In addition, the lift means 6 comprises a lifter chamber 7 delimited by the second end of the control arm 5. The lifter chamber 7 is in continuous flow connection with the discharge chamber 9 via a connecting channel 13 in the lift means. A pressure chamber 10, which is in flow connection with a side channel 12 and a second side channel 11, is provided at the first end of the body 2. The second side channel 11 is located in the lift means 6. The side channel 12 is located between the control arm 5 and the lift means 6. The lift means 6 is provided with a piston surface 22 delimiting the pressure chamber 10.

A chamber 14 delimited by a second piston surface 17 of the lift means 6 is provided at the second end of the body 2. The chamber 14 encloses a spring 15, which urges the lift means 6 toward the first end of the body. Instead of, or in addition to, the spring 15 the lift means 6 may be loaded in a similar way by pressurised hydraulic medium, which is led into the chamber 14 through a pressure conduit 16. The pressure of the hydraulic medium in the chamber 14 is kept constant. Hydraulic medium may be supplied into the chamber 14 from the same source as into the feed chamber 8.

While the control arm 5 is urged downwards by the actuator 20, i.e. into the body 2 from the position shown in FIG. 1, the seat valve 23 moves away from the seat surface 26 and the flow connection between the bore 18 and the side channel 12, i.e. between the inlet port 3 and the pressure chamber 10, is opened. Then, hydraulic medium flows from the feed chamber 8 via the bore 18, ring chamber 19 and side channel 12 into the pressure chamber 10. Thus, the pressure prevailing in the feed chamber 8 is transferred into the pressure chamber 10 and the force exerted by the pressure on the piston surface 22 forces the lift means 6 against the spring force of the spring and/or against the force exerted on the second piston surface 17 by the pressure of the fluid in the chamber 14. The area of the second piston surface 17 is smaller than that of the piston surface 22 and/or the pressure of the hydraulic medium in the chamber 14 is lower than that in the pressure chamber 10, whereby the lift means 6 moves downwards, i.e. projects out of the body 2. At the same time hydraulic medium flows out of the chamber 14 via the pressure conduit 16. As soon as the lift means 6 has moved to a position, in which the seat valve 23 settles again against the seat surface 26 and thus breaks the flow connection between the bore 18 and the side channel 12, the movement of the lift means 6 stops. Then, the flow connection between the inlet port 3 and the pressure chamber 10 breaks. The reference movement given to the control arm 5 by the actuator 20 is transmitted to the lift means 6 via the hydraulic circuit of the hydraulic actuator 1.

While the control arm 5 is moved by the actuator 20 in the opposite direction, i.e. out of the body 2, the second seat valve 24 moves away from the seat surface 26 and the flow connection between a second bore 21 and the lifter chamber 7, i.e. between the pressure chamber 10 and the outlet port 4, is opened. Then, hydraulic medium flows from the pressure chamber 10 via the second side channel 11, second bore 21, lifter chamber 7 and connecting channel 13 into the discharge chamber 9. From the discharge chamber 9 hydraulic medium is led via the outlet port 4 into the tank for hydraulic medium. Since the force exerted on the lift means 6 by the pressure of the hydraulic medium prevailing in the pressure chamber 10 is reduced, the lift means 6 moves in the opposite direction, i.e. upwards, due to the force generated by the spring 15 and/or the pressure prevailing in the chamber 14. As soon as the lift means 6 has moved to a position, in which the second seat valve 24 settles again against the seat surface 26 and thus breaks the flow connection between the second bore 21 and the lifter channel 7, the movement of the lift means 6 stops.

Figure 3:
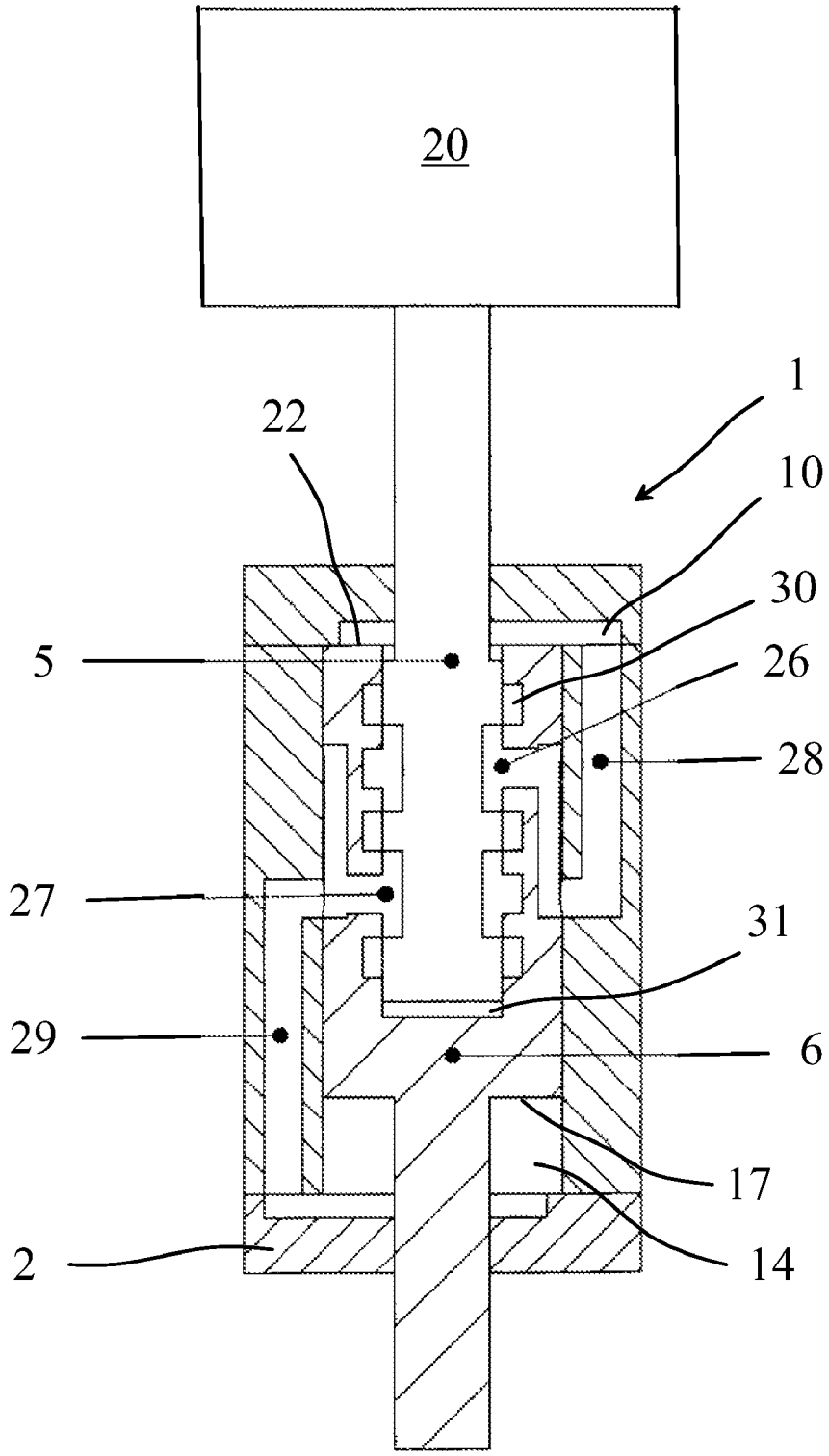
FIG. 3 is a cross-sectional view of a third hydraulic actuator according to the invention.
Figure 4:
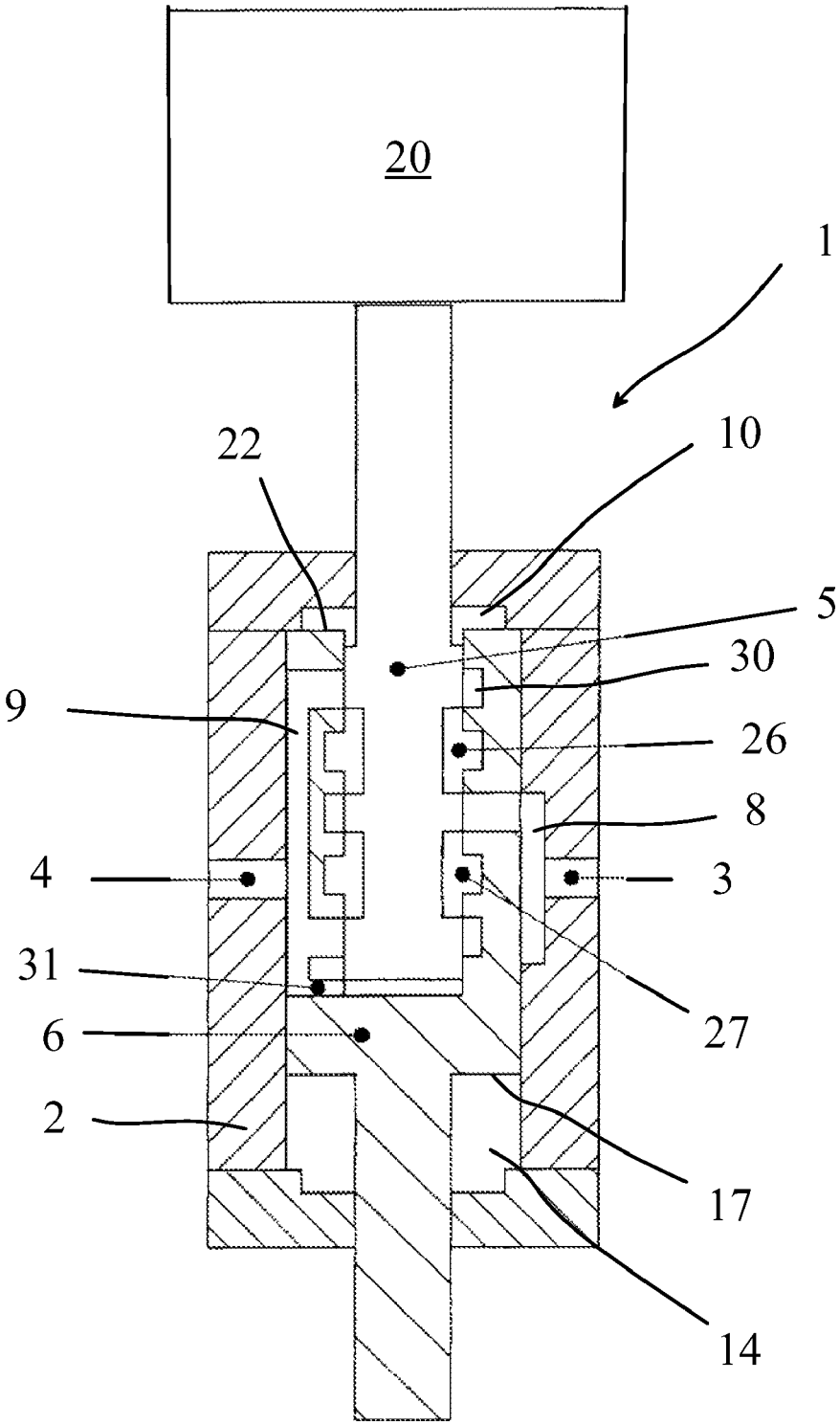
FIG. 4 is a cross-sectional view of the hydraulic actuator according to FIG. 3 turned 90 degrees.

FIGS. 3 and 4 show a third hydraulic actuator 1 according to the invention, which may also be used for controlling the gas exchange valves of a piston engine cylinder. The hydraulic actuator 1 comprises a body 2 with an inlet port 3 and an outlet port 4 for hydraulic medium. A slide 5 acting as a control arm, and a lift means 6, which are movable with respect to one another, are arranged in the body 2. The first end of the slide 5 projects from the first end of the body 2 and the second end is located inside the lift means 6 in the body 2. The slide 5 is in operational connection with an actuator 20, for instance an electromagnetic coil. The slide 5 is moved by the actuator 20, whereby the movement of the slide 5 is transmitted to the lift means 6 via the hydraulic circuit in the hydraulic actuator 1. The lift means 6 is in operational connection with the gas exchange valve of the cylinder in order to control it, i.e. to move it back and forth between an open and closed position.

The inlet port 3 is in flow connection with a source of hydraulic medium, e.g. with the forced lubrication system of the engine. The inlet port 3 is in continuous flow connection with a feed chamber 8 in the body 2. Hydraulic medium is fed by a pump from the source of hydraulic medium through the inlet port 3 into the feed chamber 8. Hydraulic medium is discharged from the hydraulic actuator 1 via the outlet port 4, which is in flow connection with a tank for hydraulic medium, e.g. with the oil sump of the engine. The outlet port 4 is in continuous flow connection with a discharge chamber 9 in the body.

The slide 5 is encircled by a slide chamber 26, which is via a channel 28 in flow connection with the pressure chamber 10. Similarly, the chamber 14 is via a second channel 29 in flow connection with a second slide chamber 27 encircling the slide 5. The lift means 6 is provided with a piston surface 22 delimiting the pressure chamber 10. In addition, the lift means 6 is provided with a second piston surface 17 delimiting the chamber 14. Moreover, the slide 5 is encircled by a third slide chamber 30, which is in flow connection with the discharge chamber 9.

While the slide 5 is moved downwards by the actuator 20, i.e. into the body 2, from the position shown in FIGS. 3 and 4, the flow connection between the feed chamber 8 and the slide chamber 26 is opened. Simultaneously, the flow connection between the second slide chamber 27 and the discharge chamber 9 opens. Then, hydraulic medium is allowed to flow from the pressure source via the inlet port 3, feed chamber 8, channel 28 and slide chamber 26 into the pressure chamber 10, and the force exerted by the pressure on the piston surface 22 urges the lift means 6 downwards, i.e. out of the body 2. At the same time, hydraulic medium flows from the chamber 14 via the second channel 29 into the second slide chamber 27 and further via the discharge chamber 9 and the outlet port 4 out of the actuator 1. The movement of the lift means 6 stops as soon as it settles into a position, in which it breaks the flow connection between the feed chamber 8 and the slide chamber 26, and between the second slide chamber 27 and the discharge chamber 9.

While the slide 5 is moved by the actuator 20 in the opposite direction, i.e. outwards from the body 2, the flow connection between the feed chamber 8 and the second slide chamber 27 is opened. In addition, the flow connection between the pressure chamber 10 and the third slide chamber 30 opens. Then, hydraulic medium is allowed to flow from the pressure source via the inlet port 3, feed chamber 8, second slide chamber 27 and second channel 29 into the chamber 14. The force exerted on the piston surface 17 by the pressure urges the lift means 6 upwards, i.e. into the body 2. Simultaneously, hydraulic medium flows from the pressure chamber 10 via the channel 28, slide chamber 26 and third slide chamber 30 into the discharge chamber 9 and further via the outlet port 4 out of the hydraulic actuator 1.

Between the slide 5 and the lift means 6 there is a leak channel 31 for hydraulic medium leaking past the slide 5. The leak channel 31 is connected to a channel leading from the outlet port 4 to the tank for hydraulic medium.

The above-described hydraulic actuators 1 may be used also in other applications, in which an actuator having short movements and producing a strong force is required, for instance in sheet perforating machines and in sheet metal work centres.

The invention claimed is:

1. A hydraulic actuator comprising a body, in which a control arm and a lift means provided with a first piston surface are arranged, which lift means is arranged to follow the reference movement of the control arm, and an inlet port and an outlet port for hydraulic medium, which body encloses a pressure chamber delimited by the first piston surface of the lift means and a chamber delimited by a second piston surface of the lift means, said second piston surface being smaller in area than said first piston surface, wherein the movement of the control arm provides a flow connection between the inlet port and the pressure chamber in order to move the lift means and the movement of the control arm provides a flow connection between the chamber and outlet port, and wherein the pressure of the hydraulic medium in the chamber is arranged to urge the lift means in the opposite direction, wherein the movement of the control arm in the opposite direction provides a flow connection between the pressure chamber and the outlet port in order to move the lift means (6) in the opposite direction, and the movement of the control arm in the opposite direction provides a flow connection between the inlet port and the chamber.

2. A hydraulic actuator according to claim 1, comprising a spring member, which is arranged to urge the lift means in the opposite direction.

3. A hydraulic actuator according to claim 1, wherein the body encloses an annular feed chamber encircling the lift means, with which chamber the inlet port is in continuous flow connection.

4. A hydraulic actuator according to claim 1, wherein the body encloses an annular discharge chamber encircling the lift means, with which chamber the outlet port is in continuous flow connection.

5. A hydraulic actuator according to claim 1, wherein the lift means comprises a first side channel and a second side channel, which are in continuous flow connection with the pressure chamber.

6. A hydraulic actuator according to claim 5, wherein the movement of the control arm provides a flow connection between the inlet port and the pressure chamber via the first side channel.

7. A hydraulic actuator according to claim 5, wherein the movement of the control arm in the opposite direction provides a flow connection between the pressure chamber and the outlet port via the second side channel.

8. A piston engine comprising a hydraulic actuator according to claim 1, which actuator is in operational connection with a gas exchange valve of the cylinder for controlling it.

9. A piston engine according to claim 8, wherein the inlet port of the actuator is in flow connection with the forced lubrication system of the engine.

10. A piston engine according to claim 8, wherein the outlet port of the actuator is in flow connection with the oil sump of the engine.

* * * * *